US010072340B2

(12) United States Patent
Teruya

(10) Patent No.: US 10,072,340 B2
(45) Date of Patent: Sep. 11, 2018

(54) METHOD OF CLEANING OF STEEL SHEET SURFACE AND USE OF A DETERGENT COMPOSITION THEREOF

(71) Applicant: KAO CORPORATION, Tokyo (JP)

(72) Inventor: Yuta Teruya, Wakayama (JP)

(73) Assignee: KAO CORPORATION, Tokyo (JP)

( * ) Notice: Subject to any disclaimer, the term of this patent is extended or adjusted under 35 U.S.C. 154(b) by 474 days.

(21) Appl. No.: 14/647,785

(22) PCT Filed: Dec. 2, 2013

(86) PCT No.: PCT/JP2013/083402
§ 371 (c)(1),
(2) Date: May 27, 2015

(87) PCT Pub. No.: WO2014/088124
PCT Pub. Date: Jun. 12, 2014

(65) Prior Publication Data

US 2015/0299869 A1 Oct. 22, 2015

(30) Foreign Application Priority Data

Dec. 5, 2012 (JP) ..... 2012-266443
Nov. 25, 2013 (JP) ..... 2013-243138

(51) Int. Cl.

| | |
|---|---|
| ***C25F 1/00*** | (2006.01) |
| ***C23G 1/19*** | (2006.01) |
| ***C11D 11/00*** | (2006.01) |
| ***C11D 1/722*** | (2006.01) |
| ***C11D 3/20*** | (2006.01) |
| ***C11D 3/33*** | (2006.01) |
| ***C25F 1/06*** | (2006.01) |

(52) U.S. Cl.
CPC ..... *C23G 1/19* (2013.01); *C11D 1/722* (2013.01); *C11D 3/2075* (2013.01); *C11D 3/33* (2013.01); *C11D 11/0029* (2013.01); *C25F 1/00* (2013.01); *C25F 1/06* (2013.01)

(58) Field of Classification Search
None
See application file for complete search history.

(56) References Cited

U.S. PATENT DOCUMENTS

2005/0003990 A1* 1/2005 Smith ..... C11D 1/02 510/421
2012/0316097 A1 12/2012 Maeyama et al.

FOREIGN PATENT DOCUMENTS

| | | | |
|---|---|---|---|
| EP | 0 296 431 | A2 | 12/1988 |
| GB | 1321513 | | 6/1973 |
| GB | 1 459 304 | | 12/1976 |
| GB | 2 017 762 | A | 10/1979 |
| JP | 60-144398 | A | 7/1985 |
| JP | 62-93385 | A | 4/1987 |
| JP | 10-324900 | A | 12/1998 |
| JP | 11-217586 | A | 8/1999 |
| JP | 2004-115715 | A | 4/2004 |
| JP | 2004-115716 | A | 4/2004 |
| JP | 2005-154716 | A | 6/2005 |
| JP | 2006-2229 | A | 1/2006 |
| JP | 2006-83271 | A | 3/2006 |
| JP | 2007-23210 | A | 2/2007 |
| JP | 2007-297461 | A | 11/2007 |
| JP | 2008-62281 | A | 3/2008 |
| JP | 2008-127490 | A | 6/2008 |
| JP | 2009-41078 | A | 2/2009 |
| JP | 2011-117043 | A | 6/2011 |
| WO | WO 2011/105449 | A1 | 9/2011 |

OTHER PUBLICATIONS

The International Preliminary Report on Patentability along with the Written Opinion of the International Searching Authority issued in the corresponding International Application No. PCT/JP2013/083402 dated Jun. 18, 2015.
International Search Report, issued in PCT/JP2013/083402, dated May 23, 2014.

* cited by examiner

*Primary Examiner* — Arun S Phasge
(74) *Attorney, Agent, or Firm* — Birch, Stewart, Kolasch & Birch, LLP

(57) ABSTRACT

The present invention provides a method of manufacturing a steel sheet using a detergent for a steel sheet having a good washing property for the oil stain even at a low temperature. The method of manufacturing of the present invention is a method of manufacturing a steel sheet, comprising: a washing step of soaking a steel sheet to which a stain is stuck in a detergent for a steel sheet for washing and a rinsing step of rinsing with water the steel sheet that is soaked and washed after the washing step, wherein the detergent for a steel sheet comprises: an alkali agent, one or more organic acid(s) or salt(s) selected from lactic acid, oxalic acid, citric acid, and salts of these, a nonionic surfactant represented by the general formula (1), one or more chelating agent(s) selected from gluconic acid, ethylenediaminetetraacetic acid, and salts of these, and water.

14 Claims, No Drawings

METHOD OF CLEANING OF STEEL SHEET SURFACE AND USE OF A DETERGENT COMPOSITION THEREOF

FIELD OF THE INVENTION

The present invention relates to a method of manufacturing a steel sheet.

BACKGROUND OF THE INVENTION

Washing of a steel sheet is necessary as a pretreatment before a surface treatment such as coating of the surface of the steel sheet, and is a very large factor to determine the quality of the product. Examples of the stain attached to the surface of a steel sheet include oil stains of rolling oil that attaches during cold rolling and rust preventive oil. In the cold rolling of a steel sheet in recent years, there has been used rolling oil that is suitable for improving the mill cleaning property and the productivity, and an excellent washing property for the rolling oil has been required.

Reduction of carbon dioxide emission has also been required as the environmental awareness increases, and it is not an exception in the iron and steel production. Accordingly, there has been attempted the development of a detergent that exhibits an excellent washing property even at a lower temperature than a conventional washing temperature of 70° C. to 90° C. in the washing of a steel sheet in order to reduce the energy cost that is related to the carbon dioxide emission.

JP-A-2011-117043 discloses an alkali detergent for a steel sheet that contains an alkali agent, a specified nonionic surfactant, a chelating agent, and water to efficiently wash away the stain on a steel sheet and suppress the foaming while suppressing slipping of the steel sheet on a roll at a low washing temperature of 40° C. to 60° C.

SUMMARY OF THE INVENTION

The present invention provides a method of manufacturing a steel sheet, including a washing step of soaking a steel sheet to which a stain is stuck in a detergent for a steel sheet for washing and a rinsing step of rinsing with water the steel sheet that is soaked and washed after the washing step, in which the detergent for a steel sheet contains (A) an alkali agent, (B) one or more organic acid(s) or salt(s) selected from lactic acid, oxalic acid, citric acid, and salts of these, (C) a nonionic surfactant represented by the following general formula (1):

$$R^1—O—\{(EO)_n/(PO)_m\}—H \quad (1)$$

($R^1$ represents an aliphatic hydrocarbon group having 8 or more and 16 or less carbon atoms, EO represents an ethyleneoxy group, PO represents a propyleneoxy group, n represents the average addition number of moles of EO, m represents the average addition number of moles of PO, n is a number that satisfies 2 or more and 20 or less, m is a number that satisfies 1 or more and 20 or less, and the addition form of PO and EO in { } may be either of a random arrangement and a block arrangement), (D) one or more chelating agent(s) selected from gluconic acid, ethylenediaminetetraacetic acid, and salts of these, and (E) water.

DETAILED DESCRIPTION OF THE INVENTION

Further suppression of the energy cost that is related to the carbon dioxide emission has been desired. In response to this desire, it is conceivable to use the alkali detergent for a steel sheet described in JP-A-2011-117043 at a lower temperature. However, insufficient washing tends to occur with the detergent described in JP-A-2011-117043 because the viscosity of the stain component increases at a lower washing temperature.

The present invention relates to a method of manufacturing a steel sheet using a detergent for a steel sheet having a good washing property for the oil stain even at a low temperature.

The present invention provides a method of manufacturing a steel sheet, including a washing step of soaking a steel sheet to which a stain is stuck in a detergent for a steel sheet for washing and a rinsing step of rinsing with water the steel sheet that is soaked and washed after the washing step, in which the detergent for a steel sheet contains (A) an alkali agent, (B) one or more organic acid(s) or salt(s) selected from lactic acid, oxalic acid, citric acid, and salts of these, (C) a nonionic surfactant represented by the following general formula (1):

$$R^1—O—\{(EO)_n/(PO)_m\}—H \quad (1)$$

($R^1$ represents an aliphatic hydrocarbon group having 8 or more and 16 or less carbon atoms, EO represents an ethyleneoxy group, PO represents a propyleneoxy group, n represents the average addition number of moles of EO, m represents the average addition number of moles of PO, n is a number that satisfies 2 or more and 20 or less, m is a number that satisfies 1 or more and 20 or less, and the addition form of PO and EO in { } may be either of a random arrangement and a block arrangement), (D) one or more chelating agent(s) selected from gluconic acid, ethylenediaminetetraacetic acid, and salts of these, and (E) water.

According to the present invention, it is possible to provide a method of manufacturing a steel sheet using a detergent for a steel sheet having a good washing property for the oil stain even at a low temperature.

One embodiment of the present invention is explained below.

The detergent for a steel sheet (also simply referred to as a "detergent" hereinafter) used in the method of manufacturing a steel sheet of the present embodiment contains (A) an alkali agent (also referred to as a "component A" hereinafter), (B) one or more organic acid(s) or salt(s) selected from lactic acid, oxalic acid, citric acid, and salts of these (also referred to as a "component B" hereinafter), (C) a specific nonionic surfactant (also referred to as a "component C" hereinafter), (D) one or more chelating agent(s) selected from gluconic acid, ethylenediaminetetraacetic acid, and salts of these (also referred to as a "component D" hereinafter), and (E) water.

As disclosed in JP-A-2011-117043, the conventional alkali detergent for a steel sheet contains an alkali agent, a nonionic surfactant, a chelating agent, and water. The detergent for a steel sheet of the present embodiment further contains the specific component B and the specific nonionic surfactant as the component C to give a good washing property even in a condition of lower temperature such as 30° C. The mechanism of exhibiting the effects of the present embodiment is unclear, but can be considered as described below.

In the washing at a low temperature, the washing property is considered to deteriorate due to the increase of the viscosity of the stain component on a steel sheet, such as rolling oil. However, in the present invention, the surface of the steel sheet is lightly etched by the component B and the stain component is removed together with the etched surface of the steel sheet. Therefore, it is considered that a good washing property is obtained without being affected by the increase of the viscosity under a low temperature condition. Further, the component C is hardly adsorbed onto the surface of the steel sheet compared to a surfactant containing nitrogen atoms and a surfactant having 18 or more carbon atoms because the hydrocarbon group of the component C has 8 or more and 16 or less carbon atoms. Accordingly, when the component B and the component C are combined together, a good washing property is considered to be obtained even at a low temperature without blocking of the etching of the surface of a steel sheet by the component B.

[Detergent for Steel Sheet]

<Component A: (A) Alkali Agent>

In order to ensure a property of removing the oil stain, any agent can be used as the component A as long as it is a water-soluble alkali agent. However, an inorganic alkali agent is preferable among these. Specific examples of the inorganic alkali agent include alkali metal hydroxides such as sodium hydroxide and potassium hydroxide; alkali metal silicates such as sodium orthosilicate, sodium metasilicate, and sodium sesquisilicate; alkali metal phosphates such as trisodium phosphate; alkali metal carbonates such as disodium carbonate, sodium bicarbonate, and dipotassium carbonate; and alkali metal borates such as sodium borate. Two or more types of water-soluble alkali agents may be combined together. From the viewpoint of ensuring the property of removing the oil stain and improving the washing property, alkali metal hydroxides and alkali metal silicates are preferable; sodium hydroxide, potassium hydroxide, sodium orthosilicate, and sodium metasilicate are more preferable; and sodium hydroxide and potassium hydroxide are further preferable.

The content of the component A in the detergent is preferably 0.1% by mass or more and more preferably 0.5% by mass or more from the viewpoint of ensuring the washing property and a foam-suppressing property, and is preferably 10% by mass or less, more preferably 5.0% by mass or less, and further preferably 3.0% by mass or less from the viewpoint of storage stability of the detergent.

<Component B: (B) One or More Organic Acid(s) or Salt (s) Selected from Lactic Acid, Oxalic Acid, Citric Acid, and Salts of these>

The component B is added to improve the low-temperature washing property. The component B is more preferably lactic acid, citric acid, and salts of these among lactic acid, oxalic acid, citric acid, and salts of these from the viewpoint of improving the low-temperature washing property.

The content of the component B in the detergent is preferably 0.01% by mass or more, more preferably 0.03% by mass or more, further preferably 0.05% by mass or more, furthermore preferably 0.10% by mass or more, and furthermore preferably 0.15% by mass or more from the viewpoint of improving the low-temperature washing property, and is preferably 5.0% by mass or less, more preferably 3.0% by mass or less, further preferably 1.5% by mass or less, furthermore preferably 0.80% by mass or less, furthermore preferably 0.50% by mass or less, furthermore preferably 0.40% by mass or less, and furthermore preferably 0.30% by mass or less from the viewpoint of the property of removing the oil stain. When the component B is a salt, the mass in terms of the acidic structure is brought into the above-described range.

<Component C: (C) Nonionic Surfactant>

At least one compound selected from the compounds represented by the general formula (1) is used as the component (C).

Examples of the form of the aliphatic hydrocarbon group having 8 or more and 16 or less carbon atoms that is represented by $R^1$ in the compound represented by the general formula (1) include a straight chain and a branched chain from the viewpoint of the washing property for the oil, and preferably a straight chain from the same viewpoint. Examples of the aliphatic hydrocarbon group represented by $R^1$ include a saturated hydrocarbon group (an alkyl group) and an unsaturated hydrocarbon group (an alkenyl group). $R^1$ preferably has 8 or more carbon atoms, more preferably has 10 or more carbon atoms, and further preferably has 12 or more carbon atoms; and it preferably has 14 or less carbon atoms, and more preferably has 13 or less carbon atoms. Specific examples of the compound represented by the general formula (1) include polyoxyalkylene alkyl ether and polyoxyalkylene alkenyl ether. Examples of the hydrocarbon group include a caprylic group, a capric group, an undeca group, a lauryl group, an isododecyl group, a myristyl group, and a palmityl group.

In the compound represented by the general formula (1), EO is an ethyleneoxy group and PO is a propyleneoxy group. The ethyleneoxy group and the propyleneoxy group have a distribution of the addition number of moles. The average addition number of moles n of the ethyleneoxy group is 2 or more and 20 or less, and the average addition number of moles m of the propyleneoxy group is 1 or more and 20 or less from the viewpoint of the washing property for the oil. The average addition number of moles n of the ethyleneoxy group is preferably 5 or more, more preferably 8 or more, and further preferably 12 or more, and is preferably 18 or less and more preferably 16 or less from the viewpoint of the washing property for the oil. The average addition number of moles m of the propyleneoxy group is preferably 1 or more, and is preferably 10 or less, more preferably 5 or less, and further preferably 3 or less from the viewpoint of the washing property for the oil. The average addition number of moles n of the ethyleneoxy group is preferably larger than the average addition number of moles in of the propyleneoxy group from the viewpoint of the washing property for the oil.

The part $\{(EO)_n/(PO)_m\}$ in the general formula (1) shows that the arrangements of the ethyleneoxy group and the propyleneoxy group are not limited, and they may be either a block body or a random body. From the viewpoint of the washing property for the oil, a block body is preferable, and among different types of the block bodies, a three-stage block body of $-(EO)_{n1}—(PO)_m-(EO)_{n2}-$ (wherein n1+n2=n) is more preferable. n1 is preferably 1 or more, and more preferably 3 or more, and is preferably 10 or less, and more preferably 8 or less. m is preferably 1 or more, and is preferably 10 or less, more preferably 5 or less, and further preferably 3 or less. n2 is preferably 1 or more, and more preferably 3 or more, and is preferably 10 or less, and more preferably 8 or less.

The content (the total content when two or more compounds selected from the compounds represented by the general formula (1) are used together) of the component C in the detergent is preferably 0.01% by mass or more, more preferably 0.02% by mass or more, and further preferably 0.05% by mass or more from the viewpoint of ensuring the washing property for the oil, and is preferably 5.0% by mass or less, more preferably 3.0% by mass or less, further preferably 1.0% by mass or less, and furthermore preferably 0.5% by mass or less from the viewpoint of the foam-suppressing property.

The mass ratio of the component B to the component C (the component B/the component C) in the detergent of the present embodiment is preferably 0.1 or more, more preferably 0.3 or more, further preferably 0.5 or more, furthermore preferably 0.8 or more, and furthermore preferably 1.5 or more, and is preferably 20 or less, more preferably 15 or less, further preferably 10 or less, furthermore preferably 5 or less, and furthermore preferably 3 or less from the viewpoint of ensuring the washing property for the oil.

<Component D: (D) One or More Chelating Agent(s) Selected from Gluconic Acid, Ethylenediaminetetraacetic Acid, and Salts of these>

The component D is thought to improve the washing property for the oil by reacting with a stain of iron soap or the like to chelate iron ions and the like, and forming fatty acid sodium soap to make the stain easily dissolvable. The component D is gluconic acid, ethylenediaminetetraacetic acid, or salts of these; and preferably an alkali metal salt or a lower amine salt. Further, an alkali metal salt of gluconic acid or ethylenediaminetetraacetic acid is preferable from the viewpoint of the washing property for the oil. At least one component or two or more components may be used in combination for the component (D). However, preferably a combination of two or more components is used from the viewpoint of improving the washing property for the oil. A combination of gluconic acid or a salt thereof and an alkali metal salt of ethylenediaminetetraacetic acid is preferable, and a combination of sodium gluconate and sodium ethylenediaminetetraacetate is more preferable.

The content of the component D in the detergent is preferably 0.01% by mass or more, more preferably 0.05% by mass or more, and further preferably 0.10% by mass or more from viewpoints of ensuring the washing property for the oil and of the degree of improvement of the effect, and is preferably 10% by mass or less, more preferably 5.0% by mass or less, further preferably 1.0% by mass or less, and furthermore preferably 0.30% by mass or less. When the component D is a salt, the mass in terms of the acid forms is brought into the above-described range.

When gluconic acid or a salt thereof and ethylenediaminetetraacetic acid or a salt thereof are used together, the content of gluconic acid or a salt thereof is preferably higher than the content of ethylenediaminetetraacetic acid or a salt thereof from the viewpoint of improving the washing property for the oil.

<(E) Water>

Further, water is added in addition to the components A to D to prepare the detergent for a steel sheet of the present embodiment. Examples of the water include tap water, industrial water, and deionized water; and deionized water is preferable. The concentration of each of the components in the detergent for a steel sheet can be controlled by the water. A concentrated composition containing the components A to D with a low content of water may be diluted with water to adjust the concentration of each of the components when the detergent for a steel sheet of the present embodiment is used.

The water content in the detergent is preferably 75% by mass or more, more preferably 85% by mass or more, and further preferably 90% by mass or more from the viewpoint of the storage stability of the detergent, and is preferably 98.7% by mass or less, and more preferably 98.0% by mass or less from the viewpoint of improving the washing property for the oil.

When the detergent for a steel sheet of the present embodiment does not contain any component other than the components A to D, the content of water in the detergent for a steel sheet is the remainder of the components A to D. The total content of the components A to D in the detergent for a steel sheet of the present embodiment is preferably 0.13% by mass or more and more preferably 0.5% by mass or more from the viewpoint of improving the washing property for the oil, and is preferably 25% by mass or less, more preferably 15% by mass or less, and further preferably 10% by mass or less from the viewpoint of the storage stability of the detergent.

The pH of the detergent for a steel sheet of the present embodiment is preferably 12 or more, more preferably 13 or more, and further preferably 14 or more from the viewpoint of ensuring the washing property for the oil. The pH can be adjusted in accordance with the type and the amount of the component A. Optional additives can be added to the detergent for a steel sheet of the present embodiment other than the above-described components. The additives are preferably those having a small buffering action to the pH so that the pH can be effectively adjusted by the component A.

Examples of components other than the components A to E include an antifoaming agent, a dispersant such as polyacrylic acid, and a thickener. The contents of these other components can replace a portion of the water. From the viewpoint of improving the low-temperature washing property, at least one compound selected from glycol ethers represented by the following general formula (2) is preferably used:

$$R—O-(EO)_x—R' \quad (2)$$

(R represents an aliphatic hydrocarbon group having 4 carbon atoms; R' represents a hydrogen atom or an aliphatic hydrocarbon group having 1 or more and 4 or less carbon atoms; EO represents an ethyleneoxy group; and x represents the average addition number of moles of EO, and is a number that satisfies 1 or more and 3 or less).

The compound represented by the general formula (2) is one or more compounds selected from glycol ethers in which R is an aliphatic hydrocarbon group having 4 carbon atoms and R' is a hydrogen atom or an aliphatic hydrocarbon group having 1 or more and 4 or less carbon atoms from the viewpoint of improving the low-temperature washing property.

Examples of the aliphatic hydrocarbon groups for R and R' include a straight chain group and a branched chain group, and a straight chain group is preferable from the viewpoint of improving the low-temperature washing property. An n-butyl group, an isobutyl group, and a tertiary butyl group can be used as R; and a hydrogen atom, a methyl group, an ethyl group, an n-propyl group, an isopropyl group, an n-butyl group, an isobutyl group, and a tertiary butyl group can be used as R'. R is preferably an n-butyl group or an isobutyl group, and more preferably an isobutyl group from the viewpoint of improving the low-temperature washing property. R' is preferably a hydrogen atom or an aliphatic hydrocarbon group having 4 carbon atoms, and more preferably a hydrogen atom from the viewpoint of improving the low-temperature washing property.

In the compound represented by the general formula (2), EO is an ethyleneoxy group. The ethyleneoxy group may have a distribution of the addition number of moles. From the viewpoint of improving the low-temperature washing property, the average addition number of moles x of the ethyleneoxy group is 1 or more, and is 3 or less, preferably 2 or less, and more preferably 1.

Specific examples of the compound represented by the general formula (2) include dimethyl glycol, dimethyl diglycol, butyl glycol, isobutyl glycol, butyl diglycol, butyl triglycol, dibutyl diglycol, and hexyl diglycol. Among these, butyl glycol, isobutyl glycol, butyl diglycol, butyl triglycol, and dibutyl diglycol are preferable; butyl glycol and isobutyl glycol are more preferable; and isobutyl glycol is further preferable from the viewpoint of improving the low-temperature washing property.

The content (the total content when two or more compounds are used together) of the compound represented by the general formula (2) in the detergent is preferably 0.01% by mass or more, more preferably 0.03% by mass or more, further preferably 0.08% by mass or more, and furthermore preferably 0.10% by mass or more from the viewpoint of improving the low-temperature washing property, and is preferably 5.0% by mass or less, more preferably 3.0% by mass or less, further preferably 1.0% by mass or less, and furthermore preferably 0.5% by mass or less.

The preparation method of the detergent for a steel sheet of the present embodiment is not especially limited. However, in an example of the preparation method, from the viewpoint of dissolving the component D in water, the component D and water are mixed together, and the mixture is stirred until the component D is completely dissolved to prepare a mixed liquid. Any stirring method can be used for stirring as long as a uniform mixed liquid can be obtained. Then, the component A is added in the mixed liquid containing the component D and stirred to give a mixed liquid, and further the components B and C are added in the mixed liquid.

The detergent for a steel sheet of the present embodiment can be used as a detergent to wash the stain away from a steel sheet to which an oil stain and a solid stain such as an iron powder are stuck.

In a method of manufacturing a cold-rolled steel sheet including a step of cold-rolling a steel sheet in the presence of rolling oil and a step of washing away the rolling oil that is stuck to the rolled steel sheet using a detergent, for example, the detergent for a steel sheet of the present embodiment can be used as an alkali detergent in the washing step. In other words, the same method as the conventional method can be adopted for the method of manufacturing a cold-rolled steel sheet except the detergent for a steel sheet of the present invention is used as an alkali detergent in the washing step. The cold-rolling step is a treatment step of cold-rolling a steel sheet in the presence of rolling oil in a steel mill or the like.

In the washing step of the present embodiment using the detergent for a steel sheet, the steel sheet is preferably soaked in the detergent for a steel sheet of the present embodiment. From the viewpoint of the washing property for the oil, the pH of the detergent for a steel sheet is preferably 12 or more, more preferably 13 or more, and further preferably 14 or more.

The washing temperature in the washing step is preferably 20° C. or more, and more preferably 30° C. or more from the viewpoint of the washing property for the oil, and is preferably 40° C. or less, more preferably 38° C. or less, and further preferably 35° C. or less from the viewpoint of reducing the energy cost.

The soaking time in the washing step is preferably 0.1 sec or more, and more preferably 0.5 sec or more from the viewpoint of the washing property, and is preferably 15 sec or less, and more preferably 10 sec or less from the viewpoint of the productivity of the steel sheet.

An example of a preferred steel sheet to be washed with the detergent for a steel sheet of the present embodiment is a steel sheet that has been cold-rolled with synthetic ester-based rolling oil containing palm oil.

Examples of the washing step in which the detergent for a steel sheet of the present embodiment can be used include continuous washing, that is, soak washing, spray washing, brush washing, and electrolytic washing; and an oil stain such as rolling oil and a solid stain such as an iron powder can be washed away. The washing step using the detergent for a steel sheet of the present invention is preferably soak washing and electrolytic washing, and it is suitably applied when the rolled steel sheet is passed through an alkali soak washing tank and an alkali electrolytic washing tank by a roll.

The electrolytic washing is a washing method in which the steel sheet is positively or negatively charged in a washing liquid to make a DC current flow, and is a step of removing an oil stain and a solid stain such as an iron powder that are stuck to the steel sheet by a physical force utilizing bubbles of oxygen or hydrogen that are generated from the steel sheet due to the electric current.

In the electrolytic washing using the detergent for a steel sheet of the present embodiment, the electric current density upon electrolytic washing is preferably 0.5 $A/dm^2$ or more and more preferably 1 $A/dm^2$ or more, and is preferably 30 $A/dm^2$ or less and more preferably 20 $A/dm^2$ or less.

After the washing step, a rinsing step of rinsing with water the steel sheet that is soaked and washed can be provided. The conditions such as the temperature and the soaking time in the rinsing step can be appropriately adjusted. The temperature is preferably 5° C. or more, and more preferably 15° C. or more from the viewpoint of the washing property for the oil, and is preferably 70° C. or less, and more preferably 60° C. or less from the viewpoint of reducing an energy cost. The soaking time is preferably 0.1 sec or more, and more preferably 0.5 sec or more from the viewpoint of the washing property, and is preferably 15 sec or less, and more preferably 10 sec or less from the viewpoint of the productivity of the steel sheet.

The steel sheet obtained after washing can be used for various purposes such as a steel sheet for automobiles, a steel sheet for drinks such as canned drinks, and a steel sheet for home appliances. The attached amount of the oil stain on the surface of the steel sheet after washing depends on the purpose of the steel sheet. However, it is preferably 5% or less, and more preferably 3% or less after washing regarding the mass of carbon attached to the steel sheet before washing as 100%.

The following manufacturing method, composition, and use related to the above-described embodiment are also disclosed in the present invention.

<1> A detergent for a steel sheet containing (A) an alkali agent, (B) one or more organic acid(s) or salt(s) selected from lactic acid, oxalic acid, citric acid, and salts of these, (C) a nonionic surfactant represented by the following general formula (1):

$$R^1—O—\{(EO)_n/(PO)_m\}—H \quad (1)$$

($R^1$ represents an aliphatic hydrocarbon group having 8 or more and 16 or less carbon atoms, EO represents an ethyleneoxy group, PO represents a propyleneoxy group, n represents the average addition number of moles of EO, m represents the average addition number of moles of PO, n is a number that satisfies 2 or more and 20 or less, m is a number that satisfies 1 or more and 20 or less, and the addition form of PO and EO in { } may be either of a random arrangement and a block arrangement), (D) one or more chelating agent(s) selected from gluconic acid, ethylenediaminetetraacetic acid, and salts of these, and (E) water.

<2> The detergent for a steel sheet according to <1>, in which (A) the alkali agent is preferably one or more compound(s) selected from the group consisting of alkali metal hydroxides, alkali metal silicates, alkali metal phosphates, alkali metal carbonates such as disodium carbonate, and alkali metal borates.

<3> The detergent for a steel sheet according to <1> or <2>, in which the alkali metal hydroxides are preferably one or more compound(s) selected from sodium hydroxide and potassium hydroxide; the alkali metal silicates are preferably one or more compound(s) selected from sodium orthosilicate, sodium metasilicate, and sodium sesquisilicate; the alkali metal phosphates are preferably trisodium phosphate; the alkali metal carbonates are preferably one or more compound(s) selected from disodium carbonate, sodium bicarbonate, and dipotassium carbonate; and the alkali metal borates are preferably sodium borate.

<4> The detergent for a steel sheet according to any of <1> to <3>, in which the content of (A) the alkali agent in the detergent for a steel sheet is preferably 0.1% by mass or more, more preferably 0.5% by mass or more, preferably 10% by mass or less, more preferably 5.0% by mass or less, and further preferably 3.0% by mass or less.

<5> The detergent for a steel sheet according to any of <1> to <4>, in which the content of (B) one or more organic acid(s) or salt(s) selected from lactic acid, oxalic acid, citric acid, and salts of these in the detergent for a steel sheet is preferably 0.01% by mass or more, more preferably 0.03% by mass or more, further preferably 0.05% by mass or more, furthermore preferably 0.10% by mass or more, furthermore preferably 0.15% by mass or more, preferably 5.0% by mass or less, more preferably 3.0% by mass or less, further preferably 1.5% by mass or less, furthermore preferably 0.80% by mass or less, furthermore preferably 0.50% by mass or more, furthermore preferably 0.40% by mass or less, and furthermore preferably 0.30% by mass or less.

<6> The detergent for a steel sheet according to any of <1> to <5>, in which $R^1$ of (C) the nonionic surfactant is preferably a straight chain group or a branched chain group, and is preferably a saturated hydrocarbon group (an alkyl group) and/or an unsaturated hydrocarbon group (an alkenyl group).

<7> The detergent for a steel sheet according to any of <1> to <6>, in which $R^1$ preferably has 8 or more carbon atoms, more preferably has 10 or more carbon atoms, further preferably has 12 or more carbon atoms, preferably has 14 or less carbon atoms, and more preferably has 13 or less carbon atoms.

<8> The detergent for a steel sheet according to any of <1> to <7>, in which the average addition number of moles n is preferably 5 or more, more preferably 8 or more, further preferably 12 or more, preferably 18 or less, and more preferably 16 or less.

<9> The detergent for a steel sheet according to any of <1> to <8>, in which the average addition number of moles m is preferably 1 or more, preferably 10 or less, more preferably 5 or less, and further preferably 3 or less.

<10> The detergent for a steel sheet according to any of <1> to <9>, in which the average addition number of moles n is preferably larger than the average addition number of moles m.

<11> The detergent for a steel sheet according to any of <1> to <10>, in which the content of (C) the nonionic surfactant in the detergent for a steel sheet is preferably 0.01% by mass or more, more preferably 0.02% by mass or more, further preferably 0.05% by mass or more, preferably 5.0% by mass or less, more preferably 3.0% by mass or less, further preferably 1.0% by mass or less, and furthermore preferably 0.5% by mass or less.

<12> The detergent for a steel sheet according to any of <1> to <11>, in which the mass ratio [(B) (C)] of (B) the one or more organic acid(s) or salt(s) to (C) the nonionic surfactant is preferably 0.1 or more, more preferably 0.3 or more, further preferably 0.5 or more, furthermore preferably 0.8 or more, furthermore preferably 1.5 or more, preferably 20 or less, more preferably 15 or less, further preferably 10 or less, furthermore preferably 5 or less, and furthermore preferably 3 or less.

<13> The detergent for a steel sheet according to any of <1> to <12>, in which the content of (D) the one or more chelating agent(s) selected from gluconic acid, ethylenediaminetetraacetic acid, and salts of these in the detergent for a steel sheet is preferably 0.01% by mass or more, more preferably 0.05% by mass or more, further preferably 0.10% by mass or more, preferably 10% by mass or less, more preferably 5.0% by mass or less, further preferably 1.0% by mass or less, and furthermore preferably 0.30% by mass or less.

<14> The detergent for a steel sheet according to any of <1> to <13>, in which the content of (E) the water in the detergent for a steel sheet is preferably 75% by mass or more, more preferably 85% by mass or more, further preferably 90% by mass or more, preferably 98.7% by mass or less, and more preferably 98.0% by mass or less.

<15> The detergent for a steel sheet according to any of <1> to <14>, in which the total content of (A) to (D) in the detergent for a steel sheet is preferably 0.13% by mass or more, more preferably 0.5% by mass or more, preferably 25% by mass or less, more preferably 15% by mass or less, and further preferably 10% by mass or less.

<16> The detergent for a steel sheet according to any of <1> to <15>, in which the detergent preferably contains at least one compound selected from glycol ethers represented by the following general formula (2):

$$R—O-(EO)_x—R' \quad (2)$$

(R represents an aliphatic hydrocarbon group having 4 carbon atoms; R' represents a hydrogen atom or an aliphatic hydrocarbon group having 1 or more and 4 or less carbon atoms; EO represents an ethyleneoxy group; and x represents the average addition number of moles of EC, and is a number that satisfies 1 or more and 3 or less).

<17> The detergent for a steel sheet according to any of <1> to <16>, in which R is preferably a straight chain group or a branched chain group.

<18> The detergent for a steel sheet according to any of <1> to <17>, in which R' is preferably a straight chain group or a branched chain group.

<19> The detergent for a steel sheet according to any of <1> to <18>, in which the average addition number of moles x of the ethyleneoxy group is preferably 1 or more, preferably 3 or less, more preferably 2 or less, and further preferably 1.

<20> The detergent for a steel sheet according to any of <1> to <19>, in which the content (the total content when two or more compounds are used together) of (B) the glycol ether in the detergent for a steel sheet is preferably 0.01% by mass or more, more preferably 0.03% by mass or more, further preferably 0.08% by mass or more, furthermore preferably 0.10% by mass or more, preferably 5.0% by mass or less, more preferably 3.0% by mass or less, further preferably 1.0% by mass or less, and furthermore preferably 0.5% by mass or less.

<21> The detergent for a steel sheet according to any of <1> to <20>, in which the pH is preferably 12 or more, more preferably 13 or more, and further preferably 14 or more.

<22> A method of manufacturing a steel sheet, including a washing step of soaking a steel sheet to which a stain is stuck in the detergent for a steel sheet according to any of <1> to <21> for washing and a rinsing step of rinsing with water the steel sheet that is soaked and washed after the washing step.

<23> The method of manufacturing a steel sheet according to <22>, in which the washing temperature in the washing step is preferably 20° C. or more, and more preferably 30° C. or more, preferably 40° C. or less, more preferably 38° C. or less, and further preferably 35° C. or less.

<24> The method of manufacturing a steel sheet according to <22> or <23>, in which the time of soaking the steel sheet in the detergent for a steel sheet in the washing step is preferably 0.1 sec or more, more preferably 0.5 sec or more, preferably 15 sec or less, and more preferably 10 sec or less.

<25> The method of manufacturing a steel sheet according to any of <22> to <24>, in which the washing step is preferably at least any of soak washing, spray washing, brush washing, and electrolytic washing.

<26> The method of manufacturing a steel sheet according to any of <22> to <25>, in which the washing step is electrolytic washing; and the electric current density upon electrolytic washing is preferably 0.5 A/dm$^2$ or more and more preferably 1 A/dm$^2$ or more, preferably 30 A/dm$^2$ or less and more preferably 20 A/dm$^2$ or less.

<27> Use of a detergent composition for a steel sheet containing (A) an alkali agent, (B) one or more organic acid(s) or salt(s) selected from lactic acid, oxalic acid, citric acid, and salts of these, (C) a nonionic surfactant represented by the following general formula (1):

$$R^1—O—\{(EO)_n/(PO)_m\}—H \quad (1)$$

($R^1$ represents an aliphatic hydrocarbon group having 8 or more and 16 or less carbon atoms, EO represents an ethyleneoxy group, PO represents a propyleneoxy group, n represents the average addition number of moles of EO, m represents the average addition number of moles of PO, n is a number that satisfies 2 or more and 20 or less, m is a number that satisfies 1 or more and 20 or less, and the addition form of PO and EO in may be either of a random arrangement and a block arrangement), (D) one or more chelating agent(s) selected from gluconic acid, ethylenediaminetetraacetic acid, and salts of these, and (E) water as a detergent for a steel sheet.

<28> The use of the detergent composition for a steel sheet according to <27> as a detergent for a steel sheet, in which (A) the alkali agent is preferably one or more compound(s) selected from the group consisting of alkali metal hydroxides, alkali metal silicates, alkali metal phosphates, alkali metal carbonates such as disodium carbonate, and alkali metal borates.

<29> The use of the detergent composition for a steel sheet according to <27> or <28> as a detergent for a steel sheet, in which the alkali metal hydroxides are preferably one or more compound(s) selected from sodium hydroxide and potassium hydroxide; the alkali metal silicates are preferably one or more compound(s) selected from sodium orthosilicate, sodium metasilicate, and sodium sesquisilicate; the alkali metal phosphates are preferably trisodium phosphate; the alkali metal carbonates are preferably one or more compound(s) selected from disodium carbonate, sodium bicarbonate, and dipotassium carbonate; and the alkali metal borates are preferably sodium borate.

<30> The use of the detergent composition for a steel sheet according to any of <27> to <29> as a detergent for a steel sheet, in which the content of (A) the alkali agent in the detergent for a steel sheet is preferably 0.1% by mass or more, more preferably 0.5% by mass or more, preferably 10% by mass or less, more preferably 5.0% by mass or less, and further preferably 3.0% by mass or less.

<31> The use of the detergent composition for a steel sheet according to any of <27> to <30> as a detergent for a steel sheet, in which the content of (B) the one or more organic acid(s) or salt(s) selected from lactic acid, oxalic acid, citric acid, and salts of these in the detergent for a steel sheet is preferably 0.01% by mass or more, more preferably 0.03% by mass or more, further preferably 0.05% by mass or more, furthermore preferably 0.10% by mass or more, furthermore preferably 0.15% by mass or more, preferably 5.0% by mass or less, more preferably 3.0% by mass or less, further preferably 1.5% by mass or less, furthermore preferably 0.80% by mass or less, furthermore preferably 0.50% by mass or more, furthermore preferably 0.40% by mass or less, and furthermore preferably 0.30% by mass or less.

<32> The use of the detergent composition for a steel sheet according to any of <27> to <31> as a detergent for a steel sheet, in which $R^1$ of (C) the nonionic surfactant is preferably a straight chain group or a branched chain group, and is preferably a saturated hydrocarbon group (an alkyl group) and/or an unsaturated hydrocarbon group (an alkenyl group).

<33> The use of the detergent composition for a steel sheet according to any of <27> to <32> as a detergent for a steel sheet, in which $R^1$ preferably has 8 or more carbon atoms, more preferably has 10 or more carbon atoms, further preferably has 12 or more carbon atoms, preferably has 14 or less carbon atoms, and more preferably has 13 or less carbon atoms.

<34> The use of the detergent composition for a steel sheet according to any of <27> to <33> as a detergent for a steel sheet, in which the average addition number of moles n is preferably 5 or more, more preferably 8 or more, further preferably 12 or more, preferably 18 or less, and more preferably 16 or less.

<35> The use of the detergent composition for a steel sheet according to any of <27> to <34> as a detergent for a steel sheet, in which the average addition number of moles m is preferably 1 or more, preferably 10 or less, more preferably 5 or less, and further preferably 3 or less.

<36> The use of the detergent composition for a steel sheet according to any of <27> to <35> as a detergent for a steel sheet, in which the average addition number of moles n is preferably larger than the average addition number of moles m.

<37> The use of the detergent composition for a steel sheet according to any of <27> to <36> as a detergent for a steel sheet, in which the content of (C) the nonionic surfactant in the detergent for a steel sheet is preferably 0.01% by mass or more, more preferably 0.02% by mass or more, further preferably 0.05% by mass or more, preferably 5.0% by mass or less, more preferably 3.0% by mass or less, further preferably 1.0% by mass or less, and furthermore preferably 0.5% by mass or less.

<38> The use of the detergent composition for a steel sheet according to any of <27> to <37> as a detergent for a steel sheet, in which the mass ratio [(B)/(C)] of (B) the one or more organic acid(s) or salt(s) selected from lactic acid, oxalic acid, citric acid, and salts of these to (C) the nonionic surfactant is preferably 0.1 or more, more preferably 0.3 or more, further preferably 0.5 or more, furthermore preferably 0.8 or more, furthermore preferably 1.5 or more, preferably 20 or less, more preferably 15 or less, further preferably 10 or less, furthermore preferably 5 or less, and furthermore preferably 3 or less.

<39> The use of the detergent composition for a steel sheet according to any of <27> to <38> as a detergent for a steel sheet, in which the content of (D) the one or more chelating agent(s) selected from gluconic acid, ethylenediaminetetraacetic acid, and salts of these in the detergent for a steel sheet is preferably 0.01% by mass or more, more preferably 0.05% by mass or more, further preferably 0.10% by mass or more, preferably 10% by mass or less, more preferably 5.0% by mass or less, further preferably 1.0% by mass or less, and furthermore preferably 0.30% by mass or less.

<40> The use of the detergent composition for a steel sheet according to any of <27> to <39> as a detergent for a steel sheet, in which the content of (E) the water in the detergent for a steel sheet is preferably 75% by mass or more, more preferably 85% by mass or more, further preferably 90% by mass or more, preferably 98.7% by mass or less, and more preferably 98.0% by mass or less.

<41> The use of the detergent composition for a steel sheet according to any of <27> to <40> as a detergent for a steel sheet, in which the total content of (A) to (D) in the detergent for a steel sheet is preferably 0.13% by mass or more, more preferably 0.5% by mass or more, preferably 25% by mass or less, more preferably 15% by mass or less, and further preferably 10% by mass or less.

<42> The use of the detergent composition for a steel sheet according to any of <27> to <41> as a detergent for a steel sheet, in which the detergent preferably contains at least one compound selected from glycol ethers represented by the following general formula (2):

$$R—O-(EO)_x—R' \quad (2)$$

(R represents an aliphatic hydrocarbon group having 4 carbon atoms; R' represents a hydrogen atom or an aliphatic hydrocarbon group having 1 or more and 4 or less carbon atoms; EO represents an ethyleneoxy group; and x represents the average addition number of moles of EO, and is a number that satisfies 1 or more and 3 or less).

<43> The use of the detergent composition for a steel sheet according to any of <27> to <42> as a detergent for a steel sheet, in which R is preferably a straight chain group or a branched chain group.

<44> The use of the detergent composition for a steel sheet according to any of <27> to <43> as a detergent for a steel sheet, in which R' is preferably a straight chain group or a branched chain group.

<45> The use of the detergent composition for a steel sheet according to any of <27> to <44> as a detergent for a steel sheet, in which the average addition number of moles x of the ethyleneoxy group is preferably 1 or more, preferably 3 or less, more preferably 2 or less, and further preferably 1.

<46> The use of the detergent composition for a steel sheet according to any of <27> to <45> as a detergent for a steel sheet, in which the content (the total content when two or more compounds are used together) of (B) the glycol ether in the detergent for a steel sheet is preferably 0.01% by mass or more, more preferably 0.03% by mass or more, further preferably 0.08% by mass or more, furthermore preferably 0.10% by mass or more, preferably 5.0% by mass or less, more preferably 3.0% by mass or less, further preferably 1.0% by mass or less, and furthermore preferably 0.5% by mass or less.

<47> The use of the detergent composition for a steel sheet according to any of <27> to <46> as a detergent for a steel sheet, in which the pH is preferably 12 or more, more preferably 13 or more, and further preferably 14 or more.

EXAMPLES

The present invention is explained further in detail below. However, the present invention is not limited to these examples in any way.

Preparation of Detergent for Steel Sheet

Examples 1 to 18 and Comparative Examples 1 to 10

With the components and the amount of addition shown in Table 1, 300 g of the detergent for each example was prepared by the following procedure. The unit of the amount of addition shown in Table 1 is % by mass.

1. (D) The chelating agent and water were mixed and stirred in a 300 ml beaker to obtain a mixed liquid.

2. (A) The alkali agent was added to the mixed liquid obtained in the step 1 and stirred.

3. (C) The nonionic surfactant; and (B) lactic acid, oxalic acid, and/or citric acid as the polyvalent carboxylic acid were added to the mixed liquid obtained in the step 2 and stirred to obtain a detergent.

In Example 14, isobutyl glycol was further added when (C) the nonionic surfactant and (B) the polyvalent carboxylic acid were added. In Example 17, butyl glycol was further added when (C) the nonionic surfactant and (B) the polyvalent carboxylic acid were added. In Example 18, butyl diglycol was further added when (C) the nonionic surfactant and (B) the polyvalent carboxylic acid were added.

Nonionic surfactants 1 to 3 shown in the column of (C) the nonionic surfactant in the table are the nonionic surfactants described below.

<Nonionic Surfactant 1>

The nonionic surfactant 1 is a nonionic surfactant represented by the following general formula (3) that was manufactured according to the following Manufacturing Example 1.

$$C_6H_{13}(C_6H_{13})CH—O-(EO)_5—(PO)_2-(EO)_5—H \quad (3)$$

(In the general formula (1), $R^1$ represents an alkyl group having 13 carbon atoms, n=10, m=2, and the part $\{(EO)_n/(PO)_m\}$ has a three-stage block arrangement.)

<Nonionic Surfactant 2>

The nonionic surfactant 2 is a nonionic surfactant represented by the following general formula (4) that was manufactured according to the following Manufacturing Example 2.

$$C_{12}H_{25},C_{14}H_{29}—O-(EO)_7—(PO)_{1.5}-(EO)_7—H \quad (4)$$

(In the general formula (4), $C_{12}H_{25},C_{14}H_{29}$— represents a mixture of $C_{12}H_{25}$— and $C_{14}H_{29}$—. That is, in the general formula (1), $R^1$ represents a mixture of an alkyl group having 12 carbon atoms and an alkyl group having 14 carbons, n=14, m=1.5, and the part $\{(EO)_n/(PO)_m\}$ has a three-stage block arrangement.)

<Nonionic Surfactant 3>

The nonionic surfactant 3 is a nonionic surfactant (trade name: BLAUNON O-209, manufactured by AOKI OIL INDUSTRIAL CO., LTD.) represented by the following general formula (5).

General Formula (5):

[Formula 1]

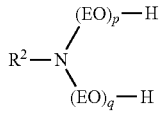

(5)

(In the general formula (5), $R^2$ represents an alkenyl group having 18 carbon atoms, and p+q=9.)

Manufacturing Example 1 (Example of Manufacturing the Nonionic Surfactant 1)

In an autoclave, 200.4 g (1 mol) of 7-tridecanol and 0.30 g (0.4% by mass) of KOH (a catalyst) were put, the air in the autoclave was substituted with nitrogen, and then the temperature inside the autoclave was increased to 130° C. while stirring 7-tridecanol. Into the autoclave was introduced 220 g (5 mol) of ethylene oxide at a pressure (gauge pressure) of 3.5 kg/cm$^2$, the reaction of 7-tridecanol and ethylene oxide was performed until the pressure decreased and became constant, and then the temperature inside the autoclave was decreased to 120° C. Then, 116 g (2 mol) of propylene oxide was introduced into the autoclave at a pressure (gauge pressure) of 3.5 kg/cm$^2$. The reaction with propylene oxide was performed until the pressure decreased and became constant, and then the temperature inside the autoclave was increased to 130° C. Into the autoclave was introduced 220 g (5 mol) of ethylene oxide at a pressure (gauge pressure) of 3.5 kg/cm$^2$, the reaction with ethylene oxide was performed until the pressure decreased and became constant, and then the temperature inside the autoclave was decreased to room temperature to obtain about 750 g of the nonionic surfactant 1.

Manufacturing Example 2 (Example of Manufacturing the Nonionic Surfactant 2)

In an autoclave, 93.2 g (0.5 mol) of n-dodecanol, 107.2 g (0.5 mol) of n-tetradecanol, and 0.30 g (0.4% by mass) of KOH (a catalyst) were put, the air in the autoclave was substituted with nitrogen, and then the temperature inside the autoclave was increased to 130° C. while stirring n-dodecanol and n-tetradecanol. Into the autoclave was introduced 308-g (7 mol) of ethylene oxide at a pressure (gauge pressure) of 3.5 kg/cm$^2$, the reaction of n-dodecanol, n-tetradecanol, and ethylene oxide was performed until the pressure decreased and became constant, and then the temperature inside the autoclave was decreased to 120° C. Then, 87 g (1.5 mol) of propylene oxide was introduced into the autoclave at a pressure (gauge pressure) of 3.5 kg/cm$^2$. The reaction with propylene oxide was performed until the pressure decreased and became constant, and then the temperature inside the autoclave was increased to 130° C. Into the autoclave was introduced 308 g (7 mol) of ethylene oxide at a pressure (gauge pressure) of 3.5 kg/cm$^2$, the reaction with ethylene oxide was performed until the pressure decreased and became constant, and then the temperature inside the autoclave was decreased to room temperature to obtain about 900 g of the nonionic surfactant 2.

[Steel Sheet Washing Test]

[Evaluation Method]

<Steel Sheet to be Washed>

A steel sheet having a thickness of 0.2 mm that had been cold-rolled with synthetic ester-based rolling oil containing palm oil was cut into a piece having a size of 60 mm×25 mm to be used in the steel sheet washing test. The amount of carbon attached to the steel sheet before washing was measured by a method similar to the method of measuring the amount of residual carbon described later, and the result was 80 mg/m$^2$.

<Procedure of Washing Test>

In a 300 ml beaker, 300 g of the detergent was put, and then the detergent was heated to the predetermined temperature shown in Table 1. Then, a pair of iron electrodes (the distance between the electrodes is 20 mm) each having a size of 100 mm long×50 mm wide were placed in the detergent. The steel sheet to be washed was soaked in the detergent for 1 sec at a position that is the center of the two electrodes and is the same distance from the two electrodes substantially parallel to the two electrodes. Subsequently, an electric current having a density of 8 A/dm$^2$ was applied by switching the voltage of the steel sheet from negative to positive for 0.35 sec each once to perform the electrolytic washing. After that, warm water at 60° C. was sprayed to the steel sheet with a spray (pressure: 2 kgf/cm$^2$) for 1 sec, the steel sheet was soaked in the warm water at 60° C. for 5 sec and rinsed, and then dried.

<Method of Measuring Amount of Residual Carbon>

A carbon and hydrogen/moisture analyzer (Carbon and Water Determination RC-612 manufactured by LECO Corporation) was used to measure the amount of carbon attached to the steel sheet (amount of residual carbon) as an index of the amount of a stain attached to the surface of the steel sheet. As the condition of the analyzer, the steel sheet was heated at 500° C. that is equal to or less than the softening temperature of iron and that is considered to be a temperature at which the stain on the steel sheet combusts, and the amount of carbon attached to the steel sheet was obtained from the amount of $CO_2$ that was generated by volatilization, thermal decomposition, or combustion. The measurement was performed until the intensity of the generated $CO_2$ dropped to 1% or less with the maximum intensity (the maximum amount of $CO_2$ that was generated) peak being 100%. Per each type of the detergent, 5 steel sheets to be washed were used and evaluated, and the average was obtained. The result is shown in Table 1. The ratio (%) of the amount of residual carbon to the amount of carbon attached before washing (80 mg/m$^2$) is also shown in Table 1. The "the nonionic surfactant 3" is not included in the nonionic surfactant represented by the general formula (1), but is shown in the column of the component (C) in Table 1 for convenience. Further, maleic acid is not included in the component (B) of the present invention, but is shown in Table 1 as (B) the polyvalent carboxylic acid for convenience.

TABLE 1

| | | Examples | | | | | | | | | | | |
|---|---|---|---|---|---|---|---|---|---|---|---|---|---|
| | | 1-1 | 1-2 | 1-3 | 2 | 3 | 4 | 5 | 6 | 7 | 8 | 9 | 10 |
| (A) Alkali Agent | Sodium Hydroxide | 2.00 | 2.00 | 2.00 | 3.00 | 2.00 | 2.00 | 2.00 | 2.00 | 2.00 | 2.00 | 2.00 | 2.00 |
| (B) Polyvalent Carboxylic Acid | Oxalic Acid | 0.10 | 0.10 | 0.10 | 0.10 | 0.10 | 0.05 | 0.20 | 0.30 | 1.00 | | | |
| | Citric Acid | | | | | | | | | | 0.10 | 0.10 | 0.30 |
| | Lactic Acid | | | | | | | | | | | | |
| | Maleic Acid | | | | | | | | | | | | |
| (C) Nonionic Surfactant | Nonionic surfactant 1 | 0.10 | 0.10 | 0.10 | 0.10 | | 0.10 | 0.10 | 0.10 | 0.10 | 0.10 | | 0.10 |
| | Nonionic Surfactant 2 | | | | | 0.10 | | | | | | 0.10 | |
| | Nonionic Surfactant 3 | | | | | | | | | | | | |
| (D) Chelating Agent | Sodium Gluconate | 0.14 | 0.14 | 0.14 | 0.14 | 0.14 | 0.14 | 0.14 | 0.14 | 0.14 | 0.14 | 0.14 | 0.14 |
| | Sodium Ethylenediamine tetraacetate | 0.02 | 0.02 | 0.02 | 0.02 | 0.02 | 0.02 | 0.02 | 0.02 | 0.02 | 0.02 | 0.02 | 0.02 |
| Glycol Ether | Isobutyl Glycol | | | | | | | | | | | | |
| | Butyl Glycol | | | | | | | | | | | | |
| | Butyl Diglycol | | | | | | | | | | | | |
| Water (Ion-exchange Water) | | Balance | Balance | Balance | Balance | Balance | Balance | Balance | Balance | Balance | Balance | Balance | Balance |
| Total | | 100.00 | 100.00 | 100.00 | 100.00 | 100.00 | 100.00 | 100.00 | 100.00 | 100.00 | 100.00 | 100.00 | 100.00 |
| Total of Components (A) + (B) + (C) + (D) | | 2.36 | 2.36 | 2.36 | 3.36 | 2.36 | 2.31 | 2.46 | 2.56 | 3.26 | 2.36 | 2.36 | 2.56 |
| Mass Ratio (B)/(C) | | 1.0 | 1.0 | 1.0 | 1.0 | 1.0 | 0.5 | 2.0 | 3.0 | 10.0 | 1.0 | 1.0 | 3.0 |
| pH | | 14 | 14 | 14 | 14 | 14 | 14 | 14 | 14 | 14 | 14 | 14 | 14 |
| Washing Temperature | | 50 | 40 | 30 | 30 | 30 | 30 | 30 | 30 | 30 | 30 | 30 | 30 |
| Evaluation Result of Washing Property | Residual Carbon Amount (mg/m$^2$) | 1.7 | 1.9 | 2.4 | 2.2 | 2.3 | 2.4 | 2.3 | 2.3 | 2.4 | 1.7 | 2.1 | 1.7 |
| | Amount of carbon attached (%) | 2.1 | 2.4 | 3.0 | 2.8 | 2.9 | 3.0 | 2.9 | 2.9 | 3.0 | 2.2 | 2.6 | 2.1 |

| | | Examples | | | | | | | | Comparative Examples | | |
|---|---|---|---|---|---|---|---|---|---|---|---|---|
| | | 11 | 12 | 13 | 14 | 15 | 16 | 17 | 18 | 1-1 | 1-2 | 2 |
| (A) Alkali Agent | Sodium Hydroxide | 2.00 | 2.00 | 2.00 | 2.00 | 2.00 | 2.00 | 2.00 | 2.00 | 2.00 | 2.00 | 2.00 |
| (B) Polyvalent Carboxylic Acid | Oxalic Acid | | | | 0.10 | 0.10 | 0.10 | 0.10 | 0.10 | | | |
| | Citric Acid | | | | | | | | | | | |
| | Lactic Acid | 0.10 | 0.10 | 0.30 | | | | | | | | |
| | Maleic Acid | | | | | | | | | | | |
| (C) Nonionic Surfactant | Nonionic surfactant 1 | 0.10 | | 0.10 | 0.10 | 0.20 | 0.30 | 0.10 | 0.10 | 0.10 | 0.10 | 0.10 |
| | Nonionic Surfactant 2 | | 0.10 | | | | | | | | | |
| | Nonionic Surfactant 3 | | | | | | | | | | | |
| (D) Chelating Agent | Sodium Gluconate | 0.14 | 0.14 | 0.14 | 0.14 | 0.14 | 0.14 | 0.14 | 0.14 | 0.14 | 0.14 | 0.24 |
| | Sodium Ethylenediamine tetraacetate | 0.02 | 0.02 | 0.02 | 0.02 | 0.02 | 0.02 | 0.02 | 0.02 | 0.02 | 0.02 | 0.02 |
| Glycol Ether | Isobutyl Glycol | | | | 0.10 | | | | | | | |
| | Butyl Glycol | | | | | | | 0.10 | | | | |
| | Butyl Diglycol | | | | | | | | 0.10 | | | |
| Water (Ion-exchange Water) | | Balance | Balance | Balance | Balance | Balance | Balance | Balance | Balance | Balance | Balance | Balance |
| Total | | 100.00 | 100.00 | 100.00 | 100.00 | 100.00 | 100.00 | 100.00 | 100.00 | 100.00 | 100.00 | 100.0 |
| Total of Components (A) + (B) + (C) + (D) | | 2.36 | 2.36 | 2.56 | 2.36 | 2.46 | 2.56 | 2.36 | 2.36 | 2.26 | 2.26 | 2.36 |
| Mass Ratio (B)/(C) | | 1.0 | 1.0 | 3.0 | 1.0 | 0.5 | 0.3 | 1.0 | 1.0 | | | |
| pH | | 14 | 14 | 14 | 14 | 14 | 14 | 14 | 14 | 14 | 14 | 14 |
| Washing Temperature | | 30 | 30 | 30 | 30 | 30 | 30 | 30 | 30 | 50 | 30 | 30 |
| Evaluation Result of | Residual Carbon Amount (mg/m$^2$) | 2.0 | 2.0 | 1.9 | 1.5 | 2.4 | 2.3 | 1.7 | 1.5 | 2.5 | 5.8 | 2.9 |

TABLE 1-continued

| | | | | | | | | | | | | |
|---|---|---|---|---|---|---|---|---|---|---|---|---|
| Washing Property | Amount of carbon attached (%) | 2.5 | 2.5 | 2.4 | 1.9 | 3.0 | 2.9 | 2.1 | 1.8 | 3.2 | 7.2 | 3.6 |

| | | | Comparative Examples | | | | | | | |
|---|---|---|---|---|---|---|---|---|---|---|
| | | | 3 | 4 | 5 | 6 | 7 | 8 | 9 | 10 |
| (A) Alkali Agent | Sodium Hydroxide | | 2.00 | 2.00 | 2.00 | 2.00 | 2.00 | 2.00 | 2.00 | 2.00 |
| (B) Polyvalent Carboxylic Acid | Oxalic Acid | | 0.10 | | | | 0.10 | | | |
| | Citric Acid | | | | | | | 0.10 | | |
| | Lactic Acid | | | | | | | | 0.10 | |
| | Maleic Acid | | | 0.10 | 0.30 | | | | | |
| (C) Nonionic Surfactant | Nonionic surfactant 1 | | 0.10 | 0.10 | 0.10 | | | | | |
| | Nonionic Surfactant 2 | | | | | | | | | |
| | Nonionic Surfactant 3 | | | | | 0.10 | 0.10 | 0.10 | 0.10 | 0.10 |
| (D) Chelating Agent | Sodium Gluconate | | | 0.14 | 0.14 | 0.14 | 0.14 | 0.14 | 0.14 | 0.24 |
| | Sodium Ethylenediamine tetraacetate | | | 0.02 | 0.02 | 0.02 | 0.02 | 0.02 | 0.02 | 0.02 |
| Glycol Ether | Isobutyl Glycol | | | | | | | | | |
| | Butyl Glycol | | | | | | | | | |
| | Butyl Diglycol | | | | | | | | | |
| Water (Ion-exchange Water) | | | Balance | Balance | Balance | Balance | Balance | Balance | Balance | Balance |
| Total | | | 100.00 | 100.00 | 100.00 | 100.00 | 100.00 | 100.00 | 100.00 | 100.00 |
| Total of Components (A) + (B) + (C) + (D) | | | 2.20 | 2.36 | 2.56 | 2.26 | 2.36 | 2.36 | 2.36 | 2.36 |
| Mass Ratio (B)/(C) | | | 1.0 | 1.0 | 3.0 | | 1.0 | 1.0 | 1.0 | |
| pH | | | 14 | 14 | 14 | 14 | 14 | 14 | 14 | 14 |
| Washing Temperature | | | 30 | 30 | 30 | 30 | 30 | 30 | 30 | 30 |
| Evaluation Result of Washing Property | Residual Carbon Amount (mg/m$^2$) | | 32.1 | 5.7 | 5.7 | 14.6 | 10.4 | 9.9 | 13.8 | 13.8 |
| | Amount of carbon attached (%) | | 40.2 | 7.1 | 7.1 | 18.3 | 12.9 | 12.4 | 17.3 | 4.5 |

Comparative Example 1-1 in Table 1 is a case in which the steel sheet was washed at 50° C. using a detergent that does not contain the component B, and Comparative Example 1-2 is a case in which the steel sheet was washed at 30° C. using the same detergent as that of Comparative Example 1-1. A good washing property was obtained at 50° C. However, the washing property deteriorated greatly at 30° C.

From the result of Table 1, it was confirmed that the detergent compositions of the present invention have a good washing property for the oil stain attached to the surface of the steel sheet compared to the detergent compositions of the comparative examples. From the result, it was found that the component B added to the detergent for a steel sheet enabled use of the detergent well under a low temperature washing condition.

Specifically, comparing Examples 1, 8, and 11 with Comparative Examples 1-2 and 2, it was found that lactic acid, inclusion of oxalic acid, and/or citric acid improves the low-temperature washing property under the same condition that the component C is used. Comparative Example 2 is an example in which the amount of the component D was increased by the amount corresponding to that of the component B.

Comparing Examples 1, 3, 8, 9, 11, and 12 with Comparative Examples 7 to 9, it was found that the effect of the low-temperature washing property by the component B is exhibited when the specified nonionic surfactant as the component C is added.

The invention claimed is:

1. A method of manufacturing a steel sheet, comprising:

a washing step of soaking a steel sheet to which a stain is stuck in a detergent for a steel sheet for washing and a rinsing step of rinsing with water the steel sheet that is soaked and washed after the washing step, wherein the detergent for a steel sheet comprises:

(A) an alkali agent, (B) one or more organic acid(s) or salt(s) selected from lactic acid, oxalic acid, citric acid, and salts of these, (C) a nonionic surfactant represented by the following general formula (1):

$$R^1—O-\{(EO)_n/(PO)_m\}—H \quad (1)$$

wherein $R^1$ represents an aliphatic hydrocarbon group having 8 or more and 16 or less carbon atoms, EO represents an ethyleneoxy group, PO represents a propyleneoxy group, n represents the average addition number of moles of EO, m represents the average addition number of moles of PO, n is a number that satisfies 2 or more and 20 or less, m is a number that satisfies 1 or more and 20 or less, and the addition form of PO and EO in { } may be either of a random arrangement and a block arrangement, (D) one or more chelating agent(s) selected from gluconic acid, ethylenediaminetetraacetic acid, and salts of these, and (E) water, wherein the content of (B) the one or more organic acid(s) or salt(s) selected from lactic acid, oxalic acid, citric acid, and salts of these is 0.01% by mass or more and 5.0% by mass or less;

wherein the washing in the washing step is electrolytic washing.

2. The method of manufacturing a steel sheet according to claim 1, wherein the washing temperature in the washing step is 40° C. or less.

3. The method of manufacturing a steel sheet according to claim 1, wherein the mass ratio [(B)/(C)] of (B) the one or more organic acid(s) or salt(s) selected from lactic acid, oxalic acid, citric acid, and salts of these to (C) the nonionic surfactant is 0.1 or more and 20 or less.

4. The method of manufacturing a steel sheet according to claim 1, wherein the time of soaking the steel sheet in the detergent for a steel sheet in the washing step is 0.1 sec or more and 15 sec or less.

5. The method of manufacturing a steel sheet according to claim 1, wherein the stain is rolling oil.

6. The method of manufacturing a steel sheet according to claim 1, wherein the content of (A) the alkali agent in the detergent for a steel sheet is 0.1% by mass or more and 10% by mass or less.

7. The method of manufacturing a steel sheet according to claim 1, wherein the content of (C) the nonionic surfactant in the detergent for a steel sheet is 0.01% by mass or more and 5.0% by mass or less.

8. The method of manufacturing a steel sheet according to claim 1, wherein the content of (D) the one or more chelating agent(s) selected from gluconic acid, ethylenediaminetetraacetic acid, and salts of these in the detergent for a steel sheet is 0.01% by mass or more and 10% by mass or less.

9. The method of manufacturing a steel sheet according to claim 1, wherein the content of (E) the water in the detergent for a steel sheet is 75% by mass or more and 98.7% by mass or less.

10. The method of manufacturing a steel sheet according to claim 1, wherein the total content of (A) to (D) in the detergent for a steel sheet is 0.13% by mass or more and 25% by mass or less.

11. The method of manufacturing a steel sheet according to claim 1, wherein the detergent contains at least one compound selected from glycol ethers represented by the following general formula (2):

$$R—O-(EO)_x—R' \quad (2)$$

wherein R represents an aliphatic hydrocarbon group having 4 carbon atoms; R' represents a hydrogen atom or an aliphatic hydrocarbon group having 1 or more and 4 or less carbon atoms; EO represents an ethyleneoxy group; and x represents the average addition number of moles of EO, and is a number that satisfies 1 or more and 3 or less.

12. The method of manufacturing a steel sheet according to claim 11, wherein the content of the glycol ether in the detergent for a steel sheet is 0.01% by mass or more and 5.0% by mass or less.

13. A method of washing a steel sheet comprising:

an electrolytic washing step that includes soaking the steel sheet in a detergent comprising (A) an alkali agent, (B) one or more organic acid(s) or salt(s) selected from lactic acid, oxalic acid, citric acid, and salts of these, (C) a nonionic surfactant represented by the following general formula (1):

$$R^1—O-\{(EO)_n/(PO)_m\}—H \quad (1)$$

wherein $R^1$ represents an aliphatic hydrocarbon group having 8 or more and 16 or less carbon atoms, EO represents an ethyleneoxy group, PO represents a propyleneoxy group, n represents the average addition number of moles of EO, m represents the average addition number of moles of PO, n is a number that satisfies 2 or more and 20 or less, m is a number that satisfies 1 or more and 20 or less, and the addition form of PO and EO in { } may be either of a random arrangement and a block arrangement, (D) one or more chelating agent(s) selected from gluconic acid, ethylenediaminetetraacetic acid, and salts of these, and (E) water as a detergent for a steel sheet, wherein the content of (B) the one or more organic acid(s) or salt(s) selected from lactic acid, oxalic acid, citric acid, and salts of these is 0.01% by mass or more and 5.0% by mass or less, as a detergent for a steel sheet.

14. The method of washing a steel sheet according to claim 13, wherein the mass ratio [(B)/(C)] of (B) the one or more organic acid(s) or salt(s) selected from lactic acid, oxalic acid, citric acid, and salts of these to (C) the nonionic surfactant is 0.1 or more and 20 or less, as a detergent for a steel sheet.

* * * * *